US010711396B2

(12) United States Patent
Sick et al.

(10) Patent No.: US 10,711,396 B2
(45) Date of Patent: Jul. 14, 2020

(54) ANTI-BLISTERING AGENT FOR TUFTED SURFACE COVERINGS

(71) Applicant: Polytex Sportbelage Produktions-GmbH, Grefrath (DE)

(72) Inventors: Stephan Sick, Willich (DE); Dirk Sander, Kerken (DE); Thomas Leszinski, Nettetal (DE); Bernd Jansen, Nettetal (DE); Quintin Keil, Never-Over-Heembeek (BE)

(73) Assignees: Polytex Sportbelage Produktions-GmbH, Grefrath (DE); EOC Belgium, Oudenarde (BE)

( * ) Notice: Subject to any disclaimer, the term of this patent is extended or adjusted under 35 U.S.C. 154(b) by 0 days.

(21) Appl. No.: 15/571,336

(22) PCT Filed: Mar. 21, 2017

(86) PCT No.: PCT/EP2017/056720
§ 371 (c)(1),
(2) Date: Nov. 2, 2017

(87) PCT Pub. No.: WO2017/162684
PCT Pub. Date: Sep. 28, 2017

(65) Prior Publication Data

US 2019/0003114 A1 Jan. 3, 2019

(30) Foreign Application Priority Data

Mar. 22, 2016 (EP) ..... 16161774

(51) Int. Cl.
*D06N 7/00* (2006.01)
*D05C 17/02* (2006.01)

(52) U.S. Cl.
CPC ..... *D06N 7/0073* (2013.01); *D05C 17/023* (2013.01); *D05D 2305/22* (2013.01);
(Continued)

(58) Field of Classification Search
CPC ..... B05D 1/00
See application file for complete search history.

(56) References Cited

U.S. PATENT DOCUMENTS 1,671,914 A 5/1928 Wescott
5,096,641 A * 3/1992 Popke ..... C08J 9/30 264/50

(Continued)

FOREIGN PATENT DOCUMENTS

DE 102010050309 A1 6/2011
EP 3222773 A1 9/2017

(Continued)

OTHER PUBLICATIONS

Korean Office Action dated Dec. 12, 2018 for corresponding Korean Application No. 10-2018-7021288.

(Continued)

*Primary Examiner* — Dah-Wei D. Yuan
*Assistant Examiner* — Kristen A Dagenais-Englehart
(74) *Attorney, Agent, or Firm* — Harness, Dickey & Pierce, P.L.C.

(57) ABSTRACT

A method of manufacturing a tufted surface covering includes incorporating tuft fiber into a backing to form the tufted surface covering, wherein the tufted surface covering includes an underside and a pile surface; coating the underside with a colloidal latex coating, wherein the colloidal latex coating has an exposed surface; wetting the exposed surface with an anti-blistering agent; and heating at least the underside to cure the colloidal latex coating into a solid latex coating.

16 Claims, 4 Drawing Sheets

(52) U.S. Cl.
CPC . *D06N 2203/042* (2013.01); *D06N 2203/066* (2013.01); *D06N 2205/023* (2013.01); *D06N 2207/06* (2013.01); *D06N 2207/08* (2013.01); *D06N 2209/1685* (2013.01); *D06N 2213/06* (2013.01)

(56) References Cited

U.S. PATENT DOCUMENTS

| | | | | |
|---|---|---|---|---|
| 5,939,514 | A * | 8/1999 | Brown | C08K 5/0025 427/379 |
| 2003/0044549 | A1 * | 3/2003 | Walters | D06N 7/0084 428/17 |
| 2008/0050519 | A1 * | 2/2008 | Hubbuch | C08J 9/06 427/244 |
| 2008/0233336 | A1 * | 9/2008 | Giannopoulos | D06N 7/0081 428/95 |
| 2012/0100289 | A1 * | 4/2012 | Egan | B05B 7/1495 427/196 |

FOREIGN PATENT DOCUMENTS

| | | | |
|---|---|---|---|
| JP | 2006-096926 | A | 4/2006 |
| KR | 10-2011-0135132 | A | 12/2011 |
| KR | 10-2012-0102727 | A | 9/2012 |
| WO | WO-2017/162684 | A1 | 9/2017 |

OTHER PUBLICATIONS

Examination Search Report for corresponding Canadian Application No. 2,984,956 dated Nov. 14, 2018.
International Preliminary Report and Written Opinion for corresponding European Application No. PCT/EP2017/056720 dated Oct. 4, 2018.
International Search Report PCT/ISA/210 for International Application No. PCT/EP2017/056720 dated Jun. 6, 2017.
Written Opinion PCT/ISA/237 for International Application No. PCT/EP2017/056720 dated Jun. 6, 2017.

* cited by examiner

ANTI-BLISTERING AGENT FOR TUFTED SURFACE COVERINGS

CROSS-REFERENCE TO RELATED APPLICATIONS

This application is a national phase under 35 U.S.C. § 371 of PCT International Application No. PCT/EP2017/056720 which has an International filing date of Mar. 21, 2017, which claims priority to European Patent Application No. 16161774.1, filed Mar. 22, 2016, the entire contents of each of which are hereby incorporated by reference.

FIELD OF THE INVENTION

The invention relates to tufted surface coverings and the production of tufted surface coverings.

BACKGROUND AND RELATED ART

Tufted surface coverings provide a surface that is made up of fibers that have been attached to a backing. Examples of a tufted surface covering include carpets and artificial turf which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

SUMMARY

The invention provides for a method of manufacturing a tufted surface covering and a tufted surface covering in the independent claims. Embodiments are given in the dependent claims.

In one aspect the invention provides for a method of manufacturing a tufted surface covering. The method comprises incorporating tuft fiber into a backing to form the tufted surface covering. This step may be alternatively worded as tufting the tuft fiber into the backing to form the tufted surface covering. The tufted surface covering comprises an underside and a pile surface. The underside is mounted onto a surface to cover it and then the pile surface is exposed. The pile surface is formed by the exposed tuft fibers. The method further comprises coating the underside with a colloidal latex coating. The colloidal latex coating has an exposed surface. The method further comprises wetting the exposed surface with an anti-blistering agent. The method further comprises heating at least the underside the cure the colloidal latex coating into a solid latex coating. When the colloidal latex coating is heated water is forced out of the colloidal latex coating. A skin or partially dried latex coating can form on the surface of the colloidal latex coating as it is being dried. Water may then be trapped underneath this thin skin surface which then may be ruptured as the water turns into steam. This may cause blistering of the solid latex coating. An anti-blistering agent is the material that causes the latex to coagulate a bit. This coagulation of the latex leaves areas where the water can escape without causing the blistering.

Anti-blistering agents may be added to the liquid colloidal latex coating before it is coated on the underside. In large enough quantities, the anti-blistering agents may make the colloidal latex unstable. Depending upon the type of anti-blistering agent, there is therefore a limit as to how much anti-blistering agent can be used. Also various anti-blistering agents may be unsuitable to store with a liquid latex for longer periods of time. Wetting the exposed surface of the anti-blistering agent may have the technical effect that larger concentrations of anti-blistering agent can be used. Wetting the exposed surface may also have the technical effect that the amount of blistering is greatly reduced.

When a blistering agent is applied to the exposed surface, there may be limited remixing of the colloidal latex and the anti-blistering agent at the surface. This may have the effect of preventing a film or reducing film formation at the exposed surface of the colloidal latex. This disruption or partial disruption of film formation may be caused coagulation of the latex near the surface. This may then reduce the blistering during drying because moisture is able to escape instead of being trapped by a film.

Various types of anti-blistering agents may be used. For example a colloidal latex such as carboxylated styrene butadiene latex may be stabilized by an anionic surfactant which is located at the particle surface and by the carboxylic acid groups which are incorporated into the polymer. When neutralized the anionic surfactant and carboxylic groups will generate a negative charge, this negative charge will result in an electrostatic repulsion that will prevent the particles from agglomerating and ensure the colloidal stability of the latex. When this electrostatic repulsion is reduced, the particles are destabilized and are able to agglomerate which will lead to loss of colloidal stability and thus coagulation of the latex particles. This reduction of electrostatic repulsion can be obtained by adding an $H^+$-donor or a cationic species. The first can be considered as a pH induced coagulation, by adding an $H^+$-donor (e.g. an acid like citric acid) the charge on both the anionic surfactant and carboxylic acid will be neutralized leading to coagulation through charge neutralization. The second can be considered as a cationic induced coagulation, by adding species with a countercharged nature the electrostatic repulsion will be reduced again leading to coagulation through charge neutralization. Suitable cationic species can be salts like NaCl, $CaCl_2$ or $AlCl_3$ or polymers like polydiallyldimethylammonium chloride or polyethyleneimine.

In another embodiment, the anti-blistering agent reduces blistering of the colloidal latex coating during heating to cure the colloidal latex coating into the solid latex coating.

In another embodiment, anti-blistering agent is a latex coagulant. Latex coagulant's in general may cause the colloidal latex to undergo coagulation. This coagulation caused by these coagulants in general may be undesirable when the colloidal latex is stored prior to being coated onto the underside. Spraying the acid on the surface may therefore be a way of using the acid to effectively reduce blistering when manufacturing a tufted surface covering. The anti-blistering agent may be a latex coagulant of colloidal latex.

In another embodiment, the anti-blistering agent is an acid. Acids in general may cause the colloidal latex to undergo coagulation. This coagulation caused by acids in general may be undesirable when the colloidal latex is stored prior to being coated onto the underside. Spraying the acid on the surface may therefore be a way of using the acid to effectively reduce blistering when manufacturing a tufted surface covering.

In another embodiment, the acid is citric acid. The use of citric acid may be beneficial because it may be an effective anti-blistering agent when wetted on the exposed surface. It may also have the benefit of being a naturally organic acid which is non-toxic.

In another embodiment, the acid is vinegar or acetic acid. The use of vinegar or acetic acid may be beneficial because it is a naturally occurring organic acid which is non-toxic.

The use of an acid in general may be beneficial because it may have the technical effect of delaying the complete solidification of the colloidal dispersion of the latex particles during curing and thus reduce the chances of blistering.

In another embodiment, the acid is any one of the following: citric acid, vinegar, acetic acid, an alcohol, an organic acid, an inorganic acid, a sulfonic acid, a mineral acid, Formic acid, Acetic acid, Propionic acid, Butyric acid, Valeric acid, Caproic acid, Oxalic acid, Lactic acid, Malic acid, Citric acid, Benzoic acid, Uric acid, Taurine, p-Toluenesulfonic acid, Trifluoromethanesulfonic acid, Aminomethylphosphonic acid, tartaric acid, malic acid, phosphoric acid, hydrochloric acid, hexanedionic acid, and combinations thereof.

After drying, The resulting latex layer on the backing which attaches the tuft fibers may have a thickness of about 1 mm. When sprayed with an acid a tenth of a millimeter on the very surface of the latex film may have a relatively low pH. Typically when tufted surface coverings are manufactured a silicon polyether compound may be added to the bulk liquid colloidal latex before it is coated. Typically very small amounts of acid or anti-blistering agent are used, for example an order of 400 g per 1 metric ton of latex. In practice between 50 g and 1000 g of acid or anti-blistering agent per 1 metric ton of latex may be used. In another example between 200 g and 800 g of latex or anti-blistering agent per metric ton of latex may be used. In yet another example between 300 g to 500 g of acid or anti-blistering agent may be used. When an anti-blistering agent is sprayed on the surface much larger concentrations of anticoagulant can be used. For example enough of the anti-blistering agent can be sprayed onto the surface such that there is about 1% of the anticoagulant on the surface as opposed to 0.04%. Spraying of the anti-blistering agent on the surface may therefore greatly reduce the blistering of the solid latex coating that results. If the tufted surface covering is manufactured in a continuous or web-based process the tufted surface covering may move between different stations when the method is performed. For example the underside may be coated with a lick roll or other coating system and then wetted by spraying or atomizing the anti-blistering agent onto the surface.

In the colloidal latex coatings that are typically used for making tufted surface coverings there may be a great deal of water. For example, the dried film may have an approximate weight of 1 kg per square meter of the backing material. Before the colloidal latex coating is dried, it may have a weight of 1.3 kg. This means that approximately 300 g of water need to be evaporated per meter.

Various apparatuses may be used for applying the anti-blistering agent. For example an atomized citric acid fog or an aerosol may be used.

In another embodiment the anti-blistering agent is a cationic-anti-blistering agent. A cationic-anti-blistering agent is an anti-blistering agent that may supply a cation which encourages the colloidal latex to clot. For example various salts may be used as a cationic-anti-blistering agent. This may be beneficial because the resulting solid latex coating may be produced without the uses of acid.

In another embodiment the cationic-anti-blistering agent is any one of the following: a salt, sodium chloride, calcium chloride, aluminum chloride, and aluminum sulfate.

In another embodiment the cationic-anti-blistering agent is a water-soluble cationic polymer. The water-soluble cationic polymers are not salts but still supply a cation which may be used to provide the anti-blistering effect.

Examples of several water-soluble cationic polymers that work are Polydiallyldimethylammonium chloride and Polyethylenimine.

Another coagulation mechanism of colloidal latexes, such as carboxylated latexes, is heat sensitization by addition of a polyether modified polysiloxane, this can be referred to as temperature induced coagulation. The mechanism of such heat sensitization may possibly be due to the formation of the polyether with the carboxylic acids on the particle surface, this may shield the electrostatic repulsion but will stabilize the particle trough sterical hindrance. When the cloud point of the polysiloxane is reached there will be no more stabilization trough sterical hindrance nor due to electrostatic repulsion and coagulation will be induced.

In another embodiment, the colloidal latex coating further comprises a temperature-sensitive latex coagulant. A temperature-sensitive latex coagulant is a material which functions as an anti-blistering agent and becomes active when the colloidal latex coating is heated to drive water from it and turn it into the solid latex coating. The use of the temperature-sensitive latex coagulant in conjunction with the anti-blistering agent that is sprayed onto the exposed surface may further provide for a solid latex coating which has greatly reduced blistering defects. Temperature-sensitive latex coagulants are typically used to reduce blistering when manufacturing a tufted surface covering. The use of these temperature-sensitive latex coagulants with the additional sprayed anti-blistering agent may provide for even greater reduction in blistering defects.

In another embodiment, the temperature-sensitive latex coagulant is a silicone polyether.

In another embodiment, the temperature-sensitive latex coagulant is a polyether modified polysiloxane.

In another embodiment, the colloidal latex coating comprises an emulsion of styrene-butadiene.

In another embodiment, the tufted surface covering is an artificial turf. For example, the tuft fiber could be artificial turf fiber and the pile surface could be an artificial turf surface.

In another embodiment, the tuft fibers are any one of the following components: a non-polar polymer, a polyolefin polymer, a thermoplastic polyolefin polymer, a polyethylene polymer, a polypropylene polymer; a polyamide polymer; a polyethylene polymer blend, nylon, polyester, wool, cotton, Teflon, Polytetrafluorethylen, and mixtures thereof.

In another embodiment the tufted surface covering is any one of the following: landscaping turf, wall covering, floor covering, automotive carpet, a carpet, an indoor carpet, an outdoor carpet, and an athletic surface.

In another aspect the invention provides for a tufted surface covering. The tufted surface covering comprises a backing. The tufted surface covering further comprises tuft fibers. The tuft fibers are tufted into the backing. The tufted surface covering further comprises an underside and a pile surface. The pile surface is formed by the tuft fibers which extend out beyond the backing. The underside is formed by a small amount of the tuft fibers and a latex coating which holds the tuft fibers to the backing. The underside may be placed on a surface. When the underside is placed on a surface the pile surface is then exposed. The tufted surface covering further comprises a latex coating on the underside for securing the tuft fibers. The latex coating in some examples may have an average pH that decreases as the distance from the backing increases. For example, as the distance from the backing on the underside increases the latex may be mixed with more acid that was used as a sprayed anti-blistering agent. As the distance from the underside increases the pH also decreases because of the larger concentration of acid. In other examples, as the average distance from the backing in the direction of the underside increases, the average density of a product of an anti-blistering agent increases. For example, if the anti-blistering agent were a salt or a temperature-sensitive latex coagulant, concentration of this anti-blistering agent or product derived from this anti-blistering agent may increase.

Artificial turf may for example include an athletic surface that is used as a substitute for a grass playing field or surface. Artificial turf may for example be used for surfaces that are used for sports, leisure, and landscaping. The artificial turf may take different forms depending upon the intended use. Artificial turf for football, baseball, soccer, field hockey, lacrosse, and other sports may have artificial turf fibers of varying thickness and length depending upon the requirements.

The colloidal suspensions used in manufacturing latex typically contain a fairly large portion of water by weight. For example, a latex coating used in manufacturing tufted surface coverings may contain in the neighborhood of 25% to 30% water. To cure the colloidal latex into the solid latex coating this water needs to be removed and expelled from the colloidal latex coating. To let this occur naturally in the air would require a large amount of manufacturing time. To accelerate the manufacturing process tufted surface coverings are typically heated to expel the water more rapidly. A disadvantage of doing this is that as the water leaves the colloidal suspension of the latex particles small amounts of water may be trapped as the colloid forms into larger and larger portions. This trapped water may then be heated enough so that it forms steams or boils or bubbles. This then may cause the blistering of the colloidal latex coating as it is cured.

So called anti-blistering agents may be added to the colloidal latex coating so this reduces the chances that amounts of water are trapped which then leads to blistering. A disadvantage of adding the anti-blistering agent to the colloidal latex coating is that it may weaken the mechanical properties of the colloidal latex coating. Another disadvantage is that the effective anti-blistering agents may be proprietary or trade secret protected formulations which may be expensive.

The benefit of spraying the anti-blistering agent on the exposed surface is that the anti-blistering agent is not added to the colloidal latex coating until after it has been coated on the underside. The liquid or colloidal latex may then have a longer shelf life as it is stored during the manufacturing process. Another benefit is that spraying the anti-blistering agent on the underside does not have a detrimental effect on the mechanical strength of the resultant tufted surface covering.

The mechanical strength of the tufted surface covering may for example be expressed as what is known as the tuft lock or tuft bind. This is the amount of force which is required to pull a tuft from its backing of the tufted surface covering. Experiments show that spraying an acid on the exposed surface does not reduce appreciably the tuft lock.

Another potential benefit is that by spraying the anti-blistering agent on the surface of the tufted surface covering the drying of the water may be more effective. For example, this may enable a larger or faster manufacturing rate. This may have the effect of reducing the cost of manufacturing the tufted surface covering.

In one embodiment, the colloidal latex coating is styrene-butadiene latex.

In another embodiment, incorporating the tufted surface covering into the backing may mean knitting or tufting the tuft fiber into the backing.

In another embodiment, the anti-blistering agent may reduce blistering of the colloidal latex coating as it is cured into the solid latex coating.

In another embodiment heating at least the underside to cure the colloidal latex coating into a solid latex coating comprises maintaining the underside within a first temperature range and/or maintaining the pile surface within a second temperature range. The first temperature range is larger than the second temperature range.

Having the tufted surface covering being cured at two different temperatures, one for the underside where the colloidal latex coating is one where the tuft fibers are may have the benefit of curing the colloidal latex coating more effectively while protecting the tuft fibers.

In another embodiment the first temperature range is any one of the following: between 140° C. and 150° C., between 130° C. and 160° C., between 120° C. and 170° C., and between 100° C. and 180° C. The second temperature range is any one of the following: between 50° C. and 70° C., between 40° C. and 80° C., between 30° C. and 90° C., and between 20° C. and 100° C. The use of these temperature ranges may have the benefit that it provides for effective curing of the colloidal latex coating while protecting the structural integrity and structure of the tuft fibers.

In another embodiment the colloidal latex coating is applied to the underside by using a lick roll or by applying using a knife over roll method. In a lick roll apparatus the underside is brought into contact with a rotating or moving part which spins in a bath of the colloidal latex and then comes in contact with the underside. The name lick roll originates from a handheld device that is used to "lick" stamp and envelopes by wetting them with a rotating cylinder.

In the knife over roll method, the colloidal latex coating is applied or dispensed on the underside of the artificial turf backing. A knife edge or other straight edge-like structure is then used to smooth and control the thickness of the colloidal latex coating. The use of either the lick roll or the knife over roll method may be beneficial because it may provide for a means of applying a uniform coating of the colloidal latex coating quickly and effectively during manufacture.

In another embodiment the heating of the underside to cure the colloidal latex coating into the solid latex coating comprises curing the colloidal latex coating radiatively. Radiative heating, for example a heating element or heat lamp, may be used to heat the surface.

In another embodiment coating the exposed surface with the anti-blistering agent comprises any one of the following: spraying the anti-blistering agent onto the exposed surface, atomizing the anti-blistering agent adjacent to the exposed surface, and generating an aerosol of the anti-blistering agent adjacent to the exposed surface, and combinations thereof. The use of any of these methods may be efficient in applying a small amount of the anti-blistering agent to wet the exposed surface.

In another embodiment the colloidal latex coating comprises between 25% and 30% water.

In another embodiment the colloidal latex coating further comprises between 45% and 50% calcium carbonate.

In another embodiment the colloidal latex coating further comprises a rheology modifier. For example the rheology modifier may be xanthan gum or an acrylate thickener.

In another embodiment, the colloidal latex coating comprises an emulsion or collide of styrene-butadiene.

In another aspect, the invention provides for an artificial turf manufactured according to any of the preceding method steps or modifications.

When examining a tufted surface covering manufactured according to the method it may in some cases be possible to differentiate between that and a tufted surface covering where the anti-blistering agent has been mixed into the colloidal latex coating. For example, there may be bleed through of the colloidal latex coating to the pile surface. The solid latex coating on the underside may be then compared to the small amounts of solidified latex within or on the pile surface surface. There may be a difference in pH as the anti-blistering agent, which is an acid, was used to wet the exposed surface.

It is understood that one or more of the aforementioned embodiments of the invention may be combined as long as the combined embodiments are not mutually exclusive.

BRIEF DESCRIPTION OF THE DRAWINGS

In the following embodiments of the invention are explained in greater detail, by way of example only, making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
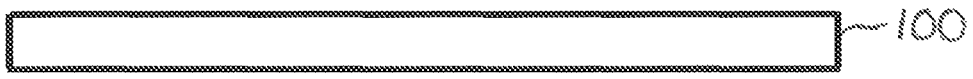
FIG. 1 partially illustrates the manufacture of a tufted surface covering.

FIG. 1-FIG. 6 are used to illustrate the manufacturing of a tufted surface covering. FIG. 1 shows an example of a backing 100. The backing 100 could be for example a woven textile, a textile formed from fibers connected together, or a material formed from one or more films.

Figure 2:
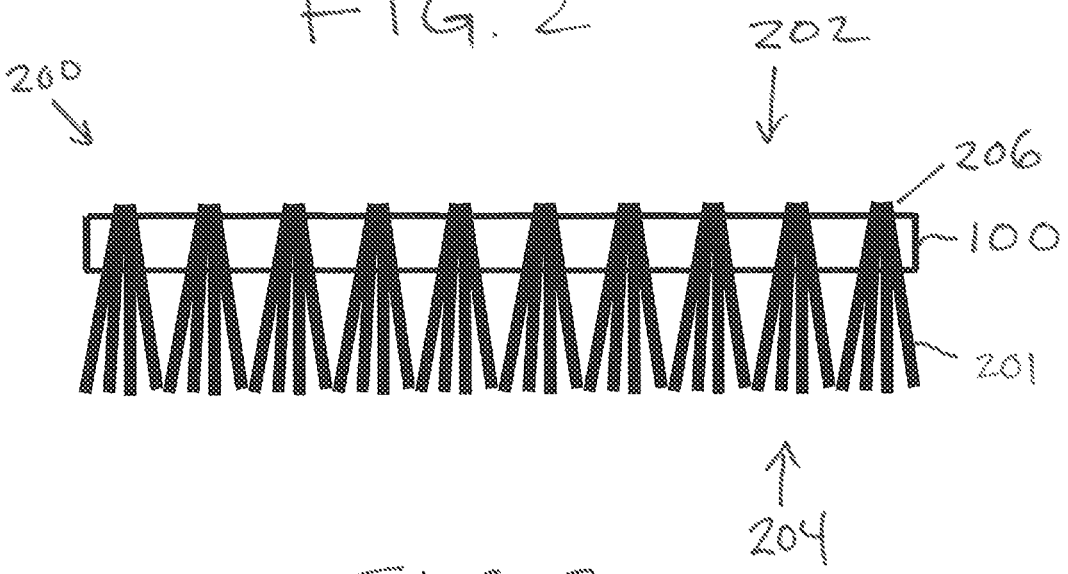
FIG. 2 partially illustrates the manufacture of a tufted surface covering.

FIG. 2 shows a tufted surface covering 200. The backing 100 has had tuft fibers 201 that have been tufted into the backing 100. It can be seen that a small loop of tuft fiber 206 extends on an underside 202. The tufted surface covering 200 has an underside 202 which can be placed onto a surface. When the underside 202 is placed onto a surface the pile surface 204 which is formed by the tuft fibers 201 is exposed. For example, if the tufted surface covering 200 were artificial turf, the underside 202 would be placed onto the playing field and the pile surface 204 would form an artificial turf surface which could then be used as an athletic surface for playing such sports as football or soccer.

Figure 3:
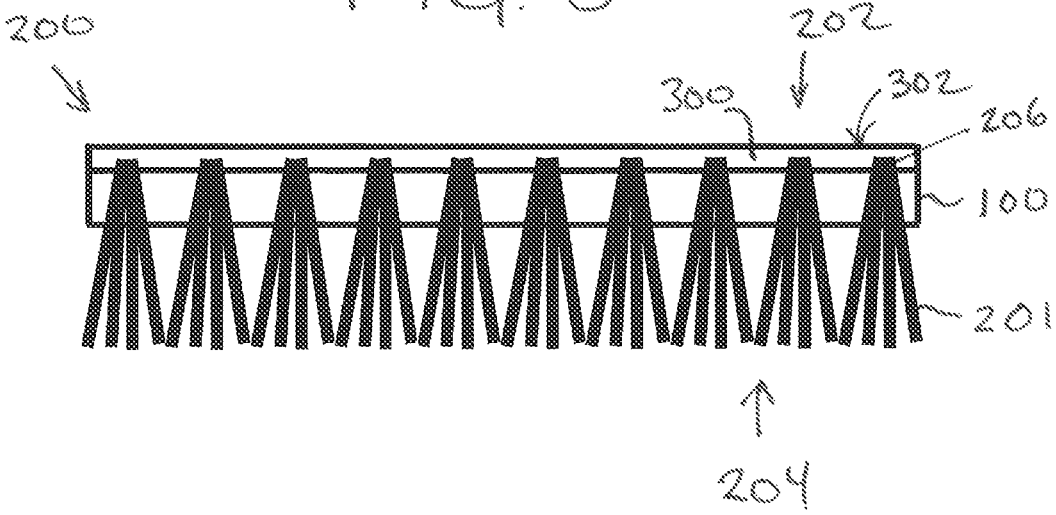
FIG. 3 partially illustrates the manufacture of a tufted surface covering.

FIG. 3 shows a further step in the manufacturing of the tufted surface covering. FIG. 3 is identical to FIG. 2 except a colloidal latex coating 300 has been spread on the underside 202. The colloidal latex coating 300 covers the underside of the backing 100 and also covers the loops 206 of tuft fiber. The colloidal latex coating has an exposed surface 302 that is exposed to the atmosphere.

Figure 4:
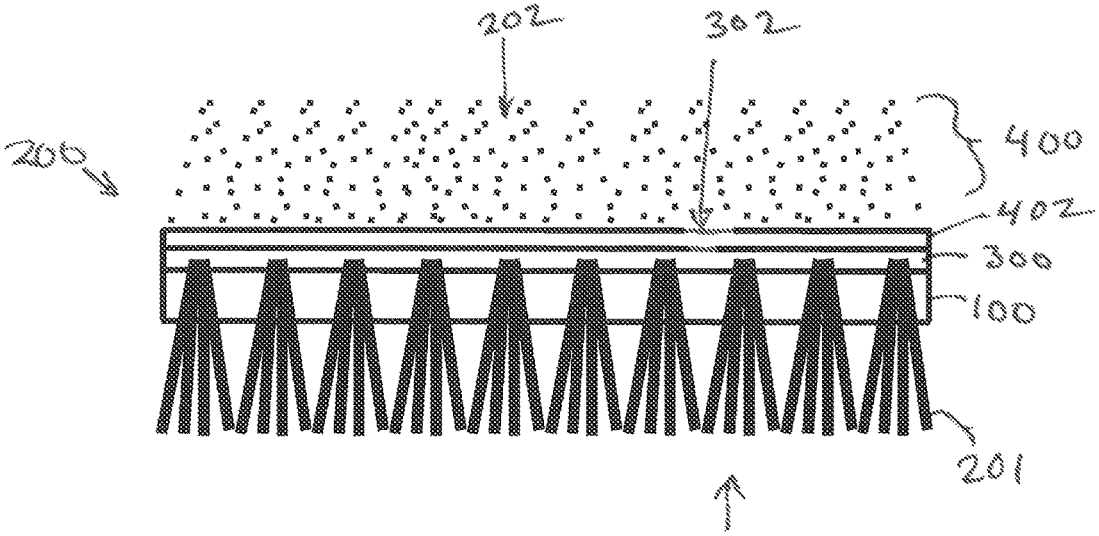
FIG. 4 partially illustrates the manufacture of a tufted surface covering.

FIG. 4 illustrates a further step in the manufacturing of a tufted surface covering 200. As the colloidal latex begins to dry, there is a tendency for a film of solid latex to form on the exposed surface. An anti-blistering agents may by sprayed on the surface to induce coagulation in the region of the exposed surface to help provide a means for moisture within the colloidal latex to escape without causing blistering. In this Fig. are shown droplets 400 of anti-blistering agent. These droplets which may be sprayed or atomized above the underside 202 form a layer 402 of colloidal latex which is mixed with anti-blistering agent. The anti-blistering agent 400 wets the exposed surface 302 of the colloidal latex coating 300. The relative scale and size of the layers and other details shown in FIGS. 1-6 are not drawn to scale. For example thickness of layers 300 and 402 are not drawn to scale. The layer mixed with anti-blistering agent 402 may also be very small in comparison to the colloidal latex coating 300. When the anti-blistering agent 400 is deposited on the exposed surface 302, it will begin to mix with the colloidal latex coating 300. It actuality, there will not be a clear separation between the colloidal latex coating and a layer mixed with the anti-blistering agent 400.

Figure 5:
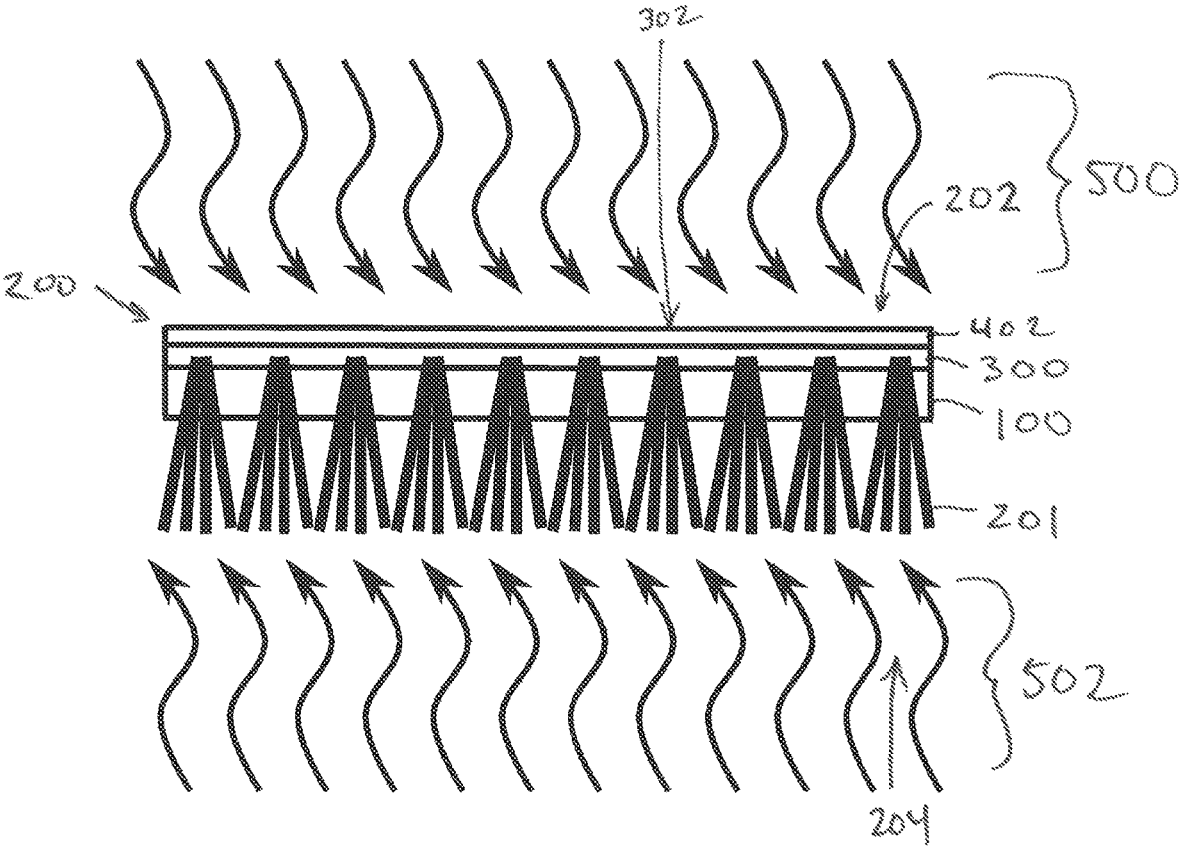
FIG. 5 partially illustrates the manufacture of a tufted surface covering.

Next in FIG. 5 the drying of the colloidal latex coating 300 is performed. In this Fig. the underside 202 is exposed to a first temperature 500 and the pile surface 204 is exposed to a second temperature 502. If lower temperatures are used then the first temperature and the second temperature may be the same. However, if it is wished to accelerate the drying of the colloidal latex coating 300 then it may be beneficial to for example provide forced air of two different temperatures. The first temperature 500 is warmer and forces the drying of the colloidal latex coating 300. The second temperature 502 may be a lower temperature which is low enough to protect and prevent damage to the tuft fiber 201 during the drying process.

Figure 6:
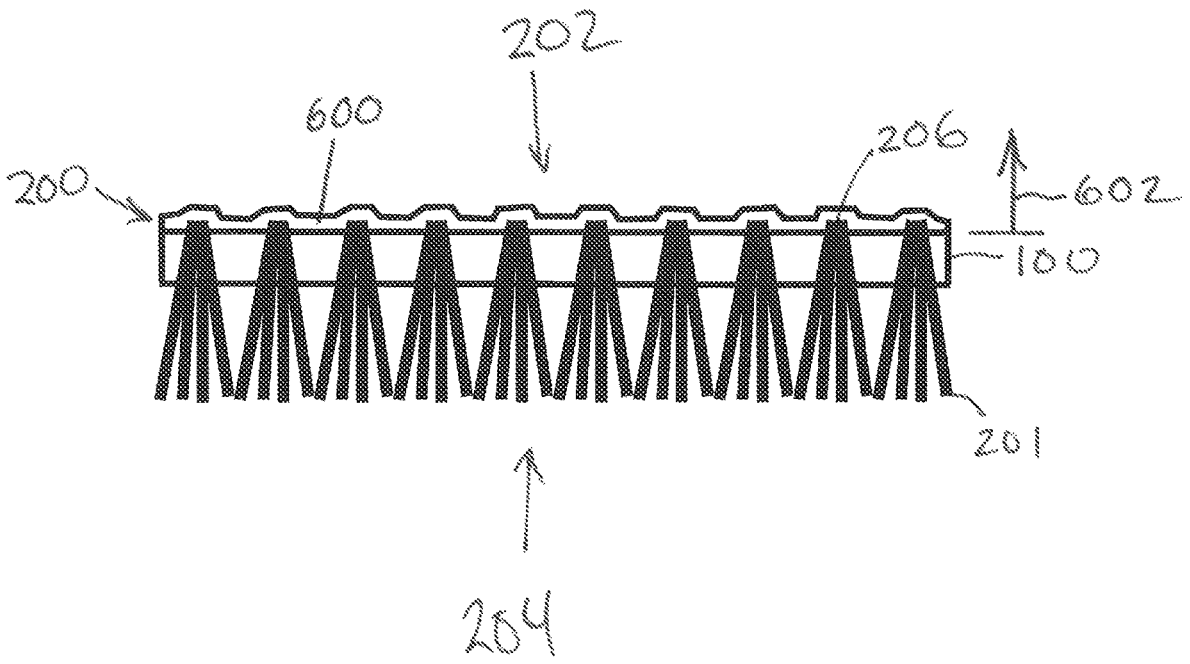
FIG. 6 illustrates an example of a tufted surface covering.

FIG. 6 shows the tufted surface covering 200 after manufacturing is finished. The colloidal latex coating has dried into a solid latex coating 600. The solid latex coating 600 covers the underside 202 of the backing 100 and also covers the loop of tuft fibers 206. This causes the loop of the tuft fibers 206 to become attached to the backing 100. The arrow 602 represents the distance from the backing 100. This arrow starts at the surface of the underside 202 of the backing 100 and goes away from the tufted surface covering 200. Because the anti-blistering agent 400 was used to wet the surface of the colloidal latex coating 300 the properties of the solid latex coating 600 may vary as the distance in the direction 602 increase. For example, the pH of the solid latex coating 600 may decrease in the direction of the arrow 602. The quantities of anti-blistering agent or products derived from the anti-blistering agent may also be present in larger quantities as the direction in the arrow 602 increases.

Figure 7:
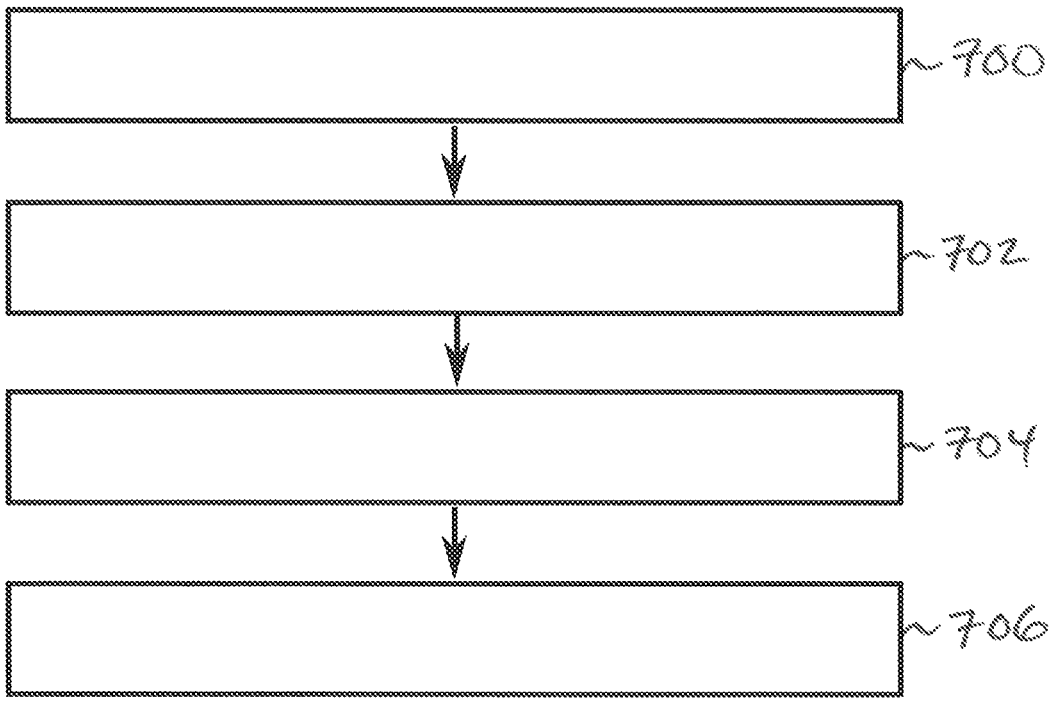
FIG. 7 shows a flow chart which illustrates a method of manufacturing a tufted surface covering.

FIG. 7 shows a flowchart which illustrates a method of manufacturing a tufted surface covering. First in step 700 tuft fibers 104 are incorporated into a backing 100 to form a tufted surface covering 200. The results of this are illustrated in FIG. 2. The tufted surface covering 200 comprises an underside 202 and a pile surface 204. Next in step 702 the underside 202 is coated with a colloidal latex coating 300. The colloidal latex coating has an exposed surface 302. This is illustrated in FIG. 3. Next in step 704 the exposed surface 302 is wetted with an anti-blistering agent 400. The process of wetting the exposed surface with the anti-blistering agent 400 is illustrated in FIG. 4. Finally, in step 706, the underside 202 is heated 500 to cure the colloidal latex coating 300 into a solid latex coating 600. The heating process is shown in FIG. 5 and the finished tufted surface covering is illustrated in FIG. 6.

Several experiments have been performed using citric acid as the anti-blistering agent. In the experiment where 20% and 40% citric acid solution was sprayed onto a colloidal latex compound prior to drying. In these tests the About 40-50 g $m^2$ of was applied during these experiments. In the experiments the blistering, the drying speed, which is related to turbidity and relative humidity, and tuft lock were examined. The colloidal latex compound examined was a styrene-butadiene latex. The results of the blistering are given qualitatively in table number 1. In table 1 it can be seen that the amount of blistering with no citric acid is the largest. With 20% solution the amount of blistering was reduced. With the 40% solution of citric acid the blistering was further reduced.

TABLE 1

| Citric Acid | Blistering |
|---|---|
| — | ++ |
| 20% solution | + |
| 40% solution | +− |

Table 2 shows the results of experiments when examining the turbidity. The results are shown as 2 minutes, 3 minutes, 4 minutes, 5 minutes, and 6 minutes. As the colloidal latex coating becomes more dry the turbidity decreases. Measuring the turbidity is in effect one measure of determining how rapidly the colloidal latex coating is drying. It can be seen that as the concentration of the citric acid increases the turbidity also decreases. This indicates that the citric acid increases the drying rate of the colloidal latex coating. This may help increase the rate at which the tufted surface covering is manufactured thereby reducing the cost.

TABLE 2

| Citric Acid | 2' | 3' | 4' | 5' | 6' |
|---|---|---|---|---|---|
| — | +++ | +++ | + | +− | − |
| 20% | +++ | +++ | +− | − | − |
| 40% | +++ | +− | − | − | − |

Table 3 shows the relative humidity as a function of time and the amount or concentration of citric acid sprayed on the surface. The results of table 3 shows that spraying citric acid on the colloidal latex coating did not seem to have an appreciable effect on the decrease of relative humidity. However, an additional test was performed by spraying more citric acid on the compound. This was about 200 g/$m^2$ of the 40% solution was applied. The relative humidity after 14 minutes in this case was only 10%. From this additional experiment it can be seen that the application of an acidic anti-blistering agent does indeed have an effect on the relative humidity and therefore the drying rate. This may therefore be used to accelerate the manufacturing process or speed the manufacturing of the tufted surface covering.

TABLE 3

| Time | No anti-blistering agent | 20% Citric Acid | 40% Citric Acid |
|---|---|---|---|
| 14' | 90% | 80% | 90% |
| 16' | 80% | 70% | 80% |

TABLE 3-continued

| Time | No anti-blistering agent | 20% Citric Acid | 40% Citric Acid |
|---|---|---|---|
| 18' | 70% | 70% | 70% |
| 20' | 30% | 30% | 30% |
| 22' | 10% | 10% | 10% |

Table 4 illustrates the tuft lock/tuft bind of the finished tufted surface covering. This is performed for the same colloidal latex coating with a control group citric acid of 20% and citric acid of 40% as before. The dry tuft lock experiments is the amount of weight needed to pull a tuft of fibers from the tufted surface covering under dry conditions. The wet tuft lock is performed after the artificial turf has been wet for a period of 24 hours. From this table it can be seen that spraying citric acid on the colloidal latex coating before the curing of the colloidal latex coating into the solid latex coating does not have a detrimental effect on the tuft lock. This is in contrast to the current method of mixing an anti-blistering agent in with the colloidal latex coating. This indicates that spraying the anti-blistering agent on the surface may result in a superior tufted surface covering.

TABLE 4

| Citric Acid | Dry tuft lock | Wet tuft lock (24 hr) |
|---|---|---|
| — | 5.0 kg | 5.2 kg |
| 20% solution | 5.1 kg | 5.4 kg |
| 40% solution | 5.0 kg | 4.9 kg. |

In conclusion, these experiments indicate that spraying citric acid on the colloidal latex coating may improve sensitivity towards blistering and turbidity. Air may not have an effect on the decrease of relative humidity unless a larger concentration of citric acid is applied. Spraying citric acid on the colloidal latex coating does not seem to have a detrimental effect on the tuft lock, it some cases it may change the appearance of the colloidal latex coating because a white brittle residue may be deposited on the surface of the colloidal latex coating. This however does not affect the end product as the underside of tufted surface covering is for example placed on the ground where it is not visible.

LIST OF REFERENCE NUMERALS

100 backing
200 tufted surface covering
201 tuft fiber
202 underside
204 pile surface
206 loop of tuft fiber
300 colloidal latex coating
302 exposed surface
400 anti-blistering agent
402 layer of colloidal latex coating mixed with anti-blistering agent
500 first temperature
502 second temperature
600 solid latex coating
602 distance from underside
700 incorporating tuft fiber into an backing to form the tufted surface covering, wherein the tufted surface covering comprises an underside and a pile surface
702 coating the underside with a colloidal latex coating
704 wetting the exposed surface with an anti-blistering agent 706 heating at least the underside to cure the colloidal latex coating into a solid latex coating

The invention claimed is:

1. A method of manufacturing a tufted surface covering, the method comprises:

incorporating tuft fibers into a backing to form the tufted surface covering, wherein the tufted surface covering comprises an underside and a pile surface;

coating the underside with a colloidal latex coating, wherein the colloidal latex coating has an exposed surface;

wetting the exposed surface with an anti-blistering agent; and heating at least the underside to cure the colloidal latex coating into a solid latex coating.

2. The method of claim 1, wherein the anti-blistering agent reduces blistering of the colloidal latex coating during heating to cure the colloidal latex coating into the solid latex coating.

3. The method of claim 1, wherein the anti-blistering agent comprises a latex coagulant.

4. The method of claim 1, wherein the anti-blistering agent comprises an acid.

5. The method of claim 4, wherein the acid is any one of the following: vinegar, an alcohol, an organic acid, an inorganic acid, a sulfonic acid, a mineral acid, Formic acid, Acetic acid, Propionic acid, Butyric acid, Valeric acid, Caproic acid, Oxalic acid, Lactic acid, Citric acid, Benzoic acid, Uric acid, Taurine, p-Toluenesulfonic acid, Trifluoromethanesulfonic acid, Aminomethylphosphonic acid, tartaric acid, malic acid, phosphoric acid, hydrochloric acid, hexanedionic acid, and combinations thereof.

6. The method of claim 1, wherein the anti-blistering agent is a cationic anti-blistering agent.

7. The method of claim 6, wherein the cationic anti-blistering agent is any one of the following: a salt, sodium chloride, calcium chloride, aluminum chloride, and aluminum sulphate.

8. The method of claim 6, wherein the cationic anti-blistering agent is any one of the following: a water soluble cationic polymer, Polydiallyldimethylammonium chloride, and Polyethylenimine.

9. The method of claim 1, wherein heating the underside to cure the colloidal latex coating into the solid latex coating comprises:

maintaining the underside within a first temperature range and/or maintaining the pile surface within a second temperature range, and wherein the first temperature range is larger than the second temperature range.

10. The method of claim 9, wherein the first temperature range is any one of the following: between 140° C. and 150° C., between 130° C. and 160° C., and between 120° C. and 170° C., between 100° C. and 180° C.; and wherein the second temperature range is any one of the following between 50° C. and 70° C., between 40° C. and 80° C., between 30° C. and 90° C., and between 20° C. and 100° C.

11. The method of claim 1, wherein the colloidal latex coating is applied to the underside by using a lick roll or by applying using a knife over roll method.

12. The method of claim 1, wherein coating the exposed surface with the anti-blistering agent comprises any one of the following: spraying the anti-blistering agent onto the exposed surface, atomizing the anti-blistering agent adjacent to the exposed surface, generating an aerosol adjacent to the exposed surface, and combinations thereof.

13. The method of claim 1, wherein the colloidal latex coating further comprises a temperature sensitive latex coagulant.

14. The method of claim 13, wherein the temperature sensitive latex coagulant comprises any one of the following: a silicone polyether and a polyether modified polysiloxane.

15. The method of claim 1, wherein the colloidal latex coating comprises an emulsion of styrene-butadiene.

16. The method of claim 1, wherein the tufted surface covering is any one of the following: artificial turf, landscaping turf, wall covering, floor covering, automotive carpet, a carpet, an indoor carpet, an outdoor carpet, and an athletic surface.

* * * * *